United States Patent [19]

Kamann et al.

[11] 4,056,036

[45] Nov. 1, 1977

[54] BOREHOLE ANCHOR

[75] Inventors: Günther Kamann; Jürgen Krahe; Ulf Zischinsky; Wilhelm Götze, all of Essen, Germany

[73] Assignee: Bergwerksverband GmbH, Essen, Germany

[21] Appl. No.: 666,633

[22] Filed: Mar. 17, 1976

[51] Int. Cl.[2] ..... F16B 13/04; F16B 31/02

[52] U.S. Cl. ..... 85/63; 61/45 B; 52/573; 52/698; 85/62

[58] Field of Search ..... 85/63, 68; 52/573, 698, 52/699; 61/45 B, 63; 85/1 T, 61, 62, 72

[56] References Cited

U.S. PATENT DOCUMENTS

| | | | |
|---|---|---|---|
| 1,645,903 | 10/1927 | Garber | 52/698 X |
| 2,615,373 | 10/1952 | Pegard | 85/62 X |
| 3,298,273 | 1/1967 | McKelvey | 85/62 |
| 3,877,235 | 4/1975 | Hill | 52/698 X |

FOREIGN PATENT DOCUMENTS

| | | | |
|---|---|---|---|
| 1,268,624 | 6/1961 | France | 85/63 |
| 2,349,659 | 4/1975 | Germany | 85/63 |

*Primary Examiner*—Ramon S. Britts
*Attorney, Agent, or Firm*—Michael J. Striker

[57] ABSTRACT

An anchor assembly or rockbolt for mounting in a borehole in a rock comprises an outer element which is secured proximal to the mouth of the borehole and an inner element which is secured well inside the borehole. The inner and outer elements are connected together in such a manner as to allow mutual limited shifting thereof without disconnection only on stressing of one of the elements relative to the other beyond a predetermined limit. To this end the outer element may be provided with a piston-like inner end that is slidable against a friction coating within a tubular inner element. It is also possible to form the inner and outer elements as separable tube sections interconnected by means of a central rod having a pair of pistons each received in a respective one of the sections and slidable therein on a tight friction lining thereof.

22 Claims, 8 Drawing Figures

FIG.1
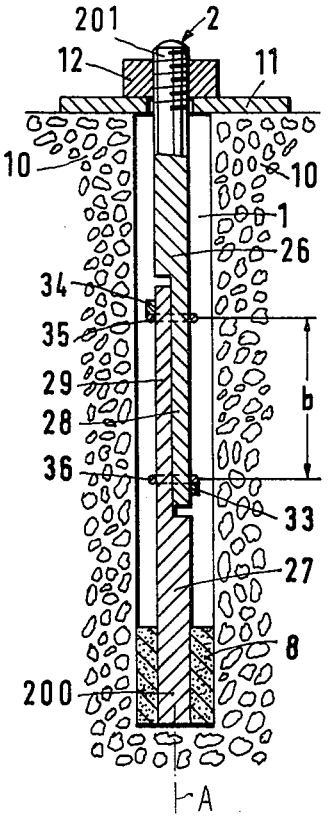
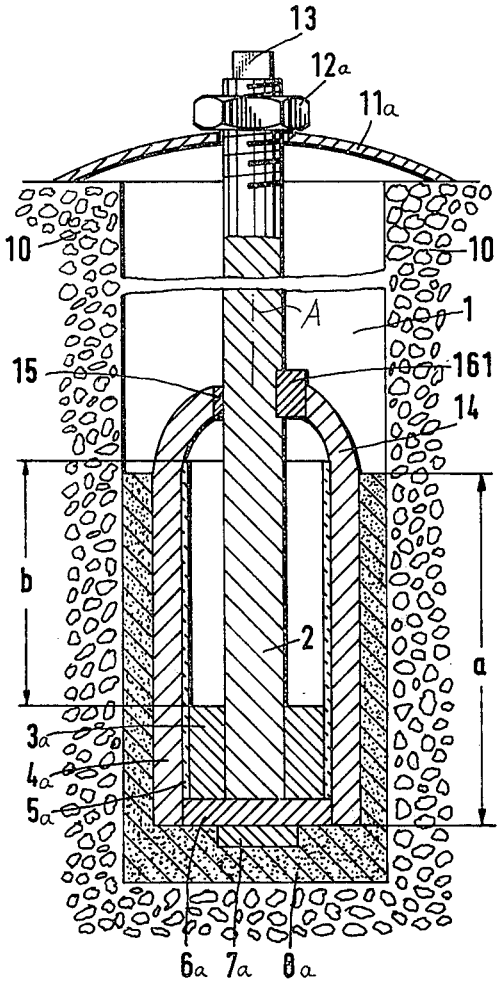
FIG.2

FIG. 3
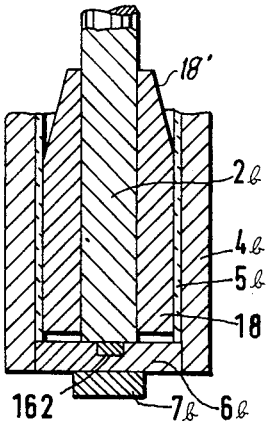
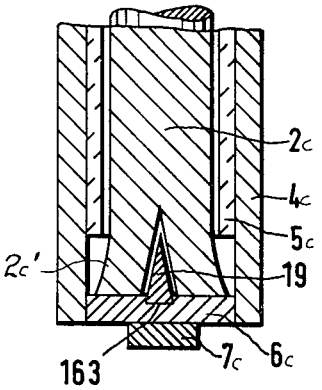
FIG. 4
FIG. 5
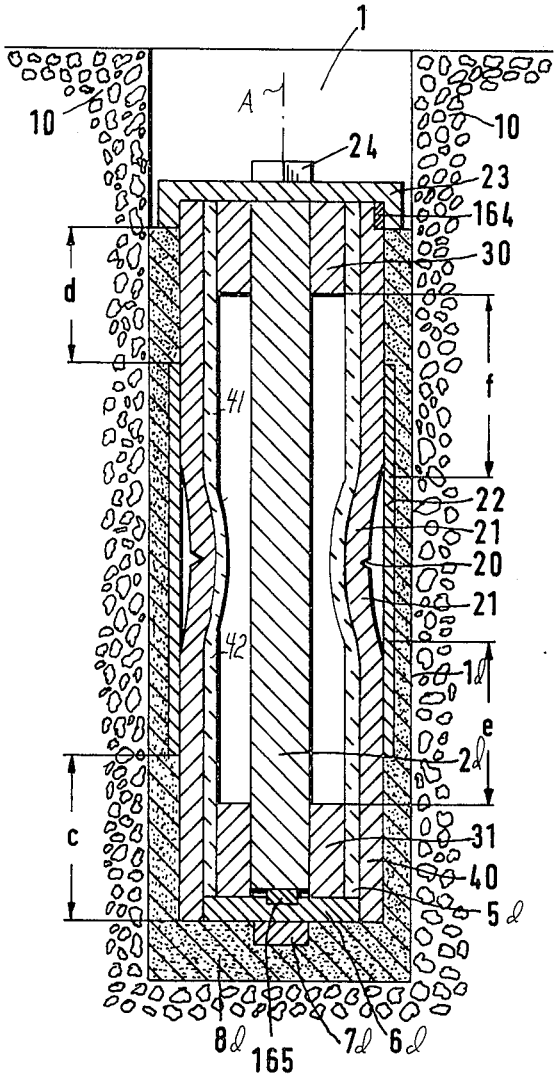

BOREHOLE ANCHOR

BACKGROUND OF THE INVENTION

This invention relates to an anchor. More particularly, this invention concerns an anchor assembly or rockbolt for mouting in a bore hole drilled in rock.

In mining and like operations it is frequently necessary to have a secure anchor to which may be attached snake-lines, guy-lines and the like. To this end a hole is bored in the rock and an anchor assembly is mounted in this hole.

In the commonest type of anchor or rockbolt, a rod is provided at one end with a foot piece that can either be secured adhesively in the base of the bore hole or which can be spread by rotation of the rod into tight engagement with the inner wall of the bore hole. At its outer end the rod is fitted with an anchor plate or washer which is locked against the rock wall face over the mouth of the bore hole by means of a nut. Thus, the rod is pre-stressed between its two ends and is therefore firmly secured in the bore hole.

A simpler arrangement simply uses the adhesive setting or mounting of an eye bolt or the like in the bore hole. Such a system is considerably simpler, but has the disadvantage that it yields readily to rock loosenings. In addition, since the entire stress on the anchor is taken up at the point where the neck of the rod extends out of the adhesive mass in which it is set, the anchor can readily break at this point when stressed beyond its elastic limit.

Since such anchors or rockbolts are necessary for supporting and holding in place many structures on which mine safety depends it is necessary that they be as secure as possible. In certain types of rock which have limited holding power and cohesiveness it is impossible to avoid at least limited shifting of the rock. Such a shifting is normally effective radially on the anchors extending into the mine. The above-described anchors or rockbolts are unable to withstand such stresses. Thus, they often rip loose from the rock, or break when so stressed. It is impossible to ascertain whether a particular anchor is ready to break. Thus, if a slight shifting in the rock has been detected it is often necessary to pull anchors and replace them or to place new anchors, as even limited shifting often stresses the prior-art anchors or rockbolts so that even a very slight shift thereafter can cause them to break.

SUMMARY OF THE INVENTION

It is therefore an object of the present invention to provide an improved rock anchor or rockbolt.

Another object is the provision of an anchor or rockbolt assembly for mounting in a bore hole in a rock which overcomes the above-given disadvantages.

Yet another object is to provide such an assembly which can withstand limited shifting in the rock without breaking or becoming so stressed that only a slight extra force is necessary for it to break.

These objects are attained in accordance with the present invention in an anchor or rockbolt assembly comprising an outer element, means for securing the outer element proximal to the mouth of the borehole, an inner element, means for securing the inner element in the borehole distal from the mouth of the borehole, and means interconnecting the inner and outer elements and allowing limited mutual shifting thereof without disconnection only on stressing of one of the elements relative to the other beyond a predetermined limit.

Thus, with the assembly according to the present invention it is possible for the anchor to take up small stresses without breaking. In this manner thermal expansion or a shifting in the rock face will not overstress the anchor assembly to the point where it is near the breaking point and only a very mild stressing can snap if off. It is possible with such a system to maintain the prestressing within the anchor assembly, as the force with which the two elements can slide relative to one another is set to be slightly more than the pre-stressing force.

The means interconnecting the two elements may in accordance with this invention be a hydraulic interconnection, a shear-force arrangement, a deformation coupling, or a pair of frictionally engaging surfaces. The force limit at which the two elements will be able to move relative to one another can be set according to the specific working conditions, as the type of rock in which the anchor is to be secured.

According to the present invention the inner and outer elements are aligned rods each having an end portion turned toward the end portion of the other element and lying against this end portion of the other element. The means interconnecting the inner and outer elements has at least one spring forcing these two surfaces together with a predetermined force so that the force necessary to shift the two elements relative to one another is determined by the force with which they are pushed together and the coefficient of friction between the two contacting surfaces. In such an arrangement it is possible to form each of the abutting portions as a semi-cylindrical extension of a cylindrical rod constituting the respective element, with the flat diametrical surfaces of these extensions lying one against the other. Each such extension is formed near its free end with a groove or projection constituting an abutment and a pair of spring-steel rings are tightly engaged around the two semi-cylindrical extensions to force their flat faces together. In such an arrangement the two elements can shift relative to one another to only a limited extent, that is until the two rings abut one against the other, thereafter shifting is only possible by breaking of one or the other element or of the springs.

According to yet another feature of this invention the second element is a sleeve that is adhesively secured in the base of the borehole. The inside of this sleeve rubs against the outside of the inner end of the outer element which itself is constituted as a rod. A special lining is provided in order to increase the coefficient of friction between these two elements.

In all such arrangements means is provided for rotationally securing the inner and outer elements together about an axis extending centrally of these two elements and adapted to lie in the center of the borehole receiving the anchor. It is possible to key the one element to the other while leaving it slidable relative to the other or to provide a small non-round projection on the one element that is received in a corresponding recess on the other element so as to prevent the two elements from rotating relative to one another so long as they are mutually engaged.

According to yet another feature of this invention the outer element is formed as a rod defining an axis on which most of the parts of the anchor are centered and which is adapted to lie in the center of the borehole receiving the anchor. This rod is secured to the rock at the mouth of the borehole either by means of a washer and nut that clamp this washer down on the face of the rock wall, or by means of a cap that is received within the borehole and has a lower edge cemented in place in the borehole. It is also possible in such an arrangement to form the elements of a single sleeve provided with a central weakened region adapted to break when the arrangement is stressed beyond certain limits and thereafter to allow the two parts to pull apart. Thus in such an arrangement it is possible to effectively provide three elements, an inner sleeve element, an outer sleeve element separable from the inner sleeve element, and a connecting element having an inner end received in the inner sleeve and an outer end received in the outer sleeve. These inner and outer ends are tightly received in the inner and outer sleeves so that only when a predetermined frictional force has been overcome can the elements slide relative to one another. Such an arrangement makes an extremely compact assembly that nevertheless has considerable deformability before break.

According to further features of this invention the inner element is a tube or sleeve closed at its end turned away from the outer element. This sleeve is provided on its closed end with a cutting tip that allows it to be turned and seated in the mortar or adhesive bedding compound. The sleeve is also formed externally with ridges or the like to ensure a good anchoring of this sleeve in the bedding compound once it is hardened.

With the system according to the present invention it is possible to manufacture the anchor without the use of extremely expensive high-strength steel or the like. This is possible due to the adjustable slip within the anchor which can be established in the anchor before its installation outside the mine in a shop. Thus a relatively simple anchor can be used in situations where normally the loading would be such that an anchor with no give could be expected to have only a very limited service life.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIGS. 1 and 2 are axial sections through two anchors in accordance with the invention;

FIGS. 3 and 4 are views of details of variants of the arrangement of FIG. 2;

FIG. 5 is an axial section through yet another anchor in accordance with the present invention;

DESCRIPTION OF THE PREFERRED EMBODIMENTS

Figure 6:
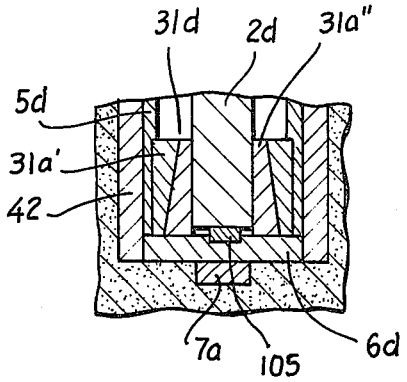
FIGS. 6 and 7 are detail views illustrating variations in the structure of FIG. 5.

FIG. 1 shows a borehole 1 sunk in a rock wall 10. An inner element formed as a cylindrical rod centered on an axis A has an inner end 200 anchored in hardened bedding compound 8 in the base of the borehole 1. An outer element 2 having an outer cylindrical rod section 26 coaxial with the section 27 has a threaded end portion 201 over which is secured a nut 12 that presses a rigid washer 11 down over the mouth of the bore 1. Rod 26 is cut away so as to have a semi-cylindrical extension 28 and the rod 27 is similarly cut away to have a semi-cylindrical extension 29. The flat diametrical faces of these extensions 28 and 29 lie snugly one against the other on the axis A. The extension 28 has at its inner end an abutment 33 extending from the side opposite its flat face and the extension 29 has a similar such abutment 34. A pair of tight spring-steel rings 35 and 36 are engaged around the two extensions 28 and 29 adjacent the abutments 34 and 33 respectively. These rings 35 and 36 are spaced apart by a distance *b* which is the distance through which the upper rod 26 can slide axially relative to the lower rod 27.

In this system the anchor without the nut 12 and washer 11 is inserted in a borehole 1 after a small quantity of hardenable bedding material 8 has been injected into the base of this borehole 1. The end 200 is forced into the bedding material 8 and this material is allowed to dry. Thereafter, the washer 11 is slipped over the end 201 and the nut 12 is screwed down so as to prestress the rods 26 and 27 between ends 200 and 201. If the outer rod 26 is pulled axially away from the inner rod 27 with a force that exceed the force with which the springs 35 and 36 press the two extensions 28 and 29 together, multiplied by the coefficient of friction of these two extensions, the outer element 26 can slip relative to the inner element 27 through the distance *b*. Such a slippage nonetheless leaves the anchor virtually as strong as before so that even if the wall changes shape somewhat a strong anchor is left in it.

In the arrangement of FIG. 2 a borehole 1 in a rock wall 10 defines an axis A on which lies an outer rod element 2*a*. The inner end of this element 2*a* is welded to a cylindrically annular body 3*a* whose outer surface is in tight frictional contact with a lining 5*a* of an inner element 4*a*. The inner element 4*a* is generally tubular and has an inner end sealed by means of a plate 6*a* and provided with a cutting tip 7*a* to facilitate its embedding in a mass 8*a* of adhesive material or concrete.

The outer end of the inner sleeve 4*a* is bent inwardly around the shaft of the outer element 2*a* and a seal 15 is provided to prevent liquid or the like from entering the space within the sleeve 3*a*. A key 161 is also provided to rotationally link the elements 2*a* and 4*a* together about the axis A.

The outer end of the outer element 2*a* is formed with a square-section projection 13 and is threaded below this projection 13 to receive a nut 12*a* that holds a domed washer 11*a* down over the mouth of the borehole 1. A wrench may be placed on this projection 13 to allow rotating of the entire assembly in the borehole 1 to seat it well within the material 8*a*. A wrench on this element 13 also allows the rod 2*a* to be held rigidly while the nut 12*a* is screwed down on the washer 11a.

In this arrangement the cylindrical outer surface of the body 3*a* can slide on the cylindrical inner surface of the lining 5*a* of the cylindrical sleeve 4*a*. The inner element is embedded by a distance a in the material 8*a* so as to be rigidly received within the borehole. The outer element 2*a*, can, however, slide through a distance *b* within this fixed inner element 4*a* when the frictional resistance between the body 3*a* and the friction lining 5*a* is overcome. It is noted that after limited axial displacement of the element 2*a* out of the element 4*a* the key 161 is pulled away from the bent-over portion 14 of the sleeve 4*a* to rotationally disconnect these two.

The friction lining 5a may be a highly frictive synthetic-resin material. It may also be a material of lower coefficient of friction in arrangements where relatively easy slippage of the elements 2a, 4a relative to one another is desired.

FIG. 3 also shows how a rod 2b identical to the rod 2a is received in a tubular inner element 4b having a lining 5b like the lining 5a can carry a body 18 having an upper end 18' which is of fructoconical shape to insure good sliding of the element 18 in the lining 5b rather than digging in. The inner end of sleeve 4b is here provided with a cap 6b having a cutting tip 7b as described above. In addition, the rod 2b is provided at its inner end with a non-cylindrical projection 162, here of square section, which is received in a correspondingly square-section hole in the plate 6b across the base of the tube 4b. This body 162 links the two elements 2b and 4b rotationally together and can replace the key 161 of FIG. 2.

The arrangement of FIG. 4 has a lining 5c in a tubular inner element 4c having a cap 6c and cutting tip 7c. The outer element 2c here is of considerably greater diameter than in FIGS. 2 and 3 and has a flared lower end 2c' formed with a central split in which is received a pointed key 19 received in a recess 163 at the bottom of the sleeve 4c in the plate 6c. Lining 5c in this case stops short of the lower end of the tube above the flared inner end 2c' of the element 2c so that when the device is mounted the tube 2c is drawn axially up to engage this flared end 2c' against the lining 5c and disengage it from the rotation coupling formation 19.

In the arrangement shown in FIG. 5 a rock wall 10 is formed with a borehole 1 having a central axis A. A generally cylindrical sleeve 40 centered on this axis A is received in this hole and has an upper section 41 and a lower section 42 having inwardly bent ends 21 separated from each other by a groove 20 constituting a weakened region between the sections 41 and 42. A sleeve 22 extends over the inner end region of the outer section 41 and the outer end region of the inner section 42. A mass 8d of hardened bedding material therefore engages in regions *d* and *c* directly against these sections 41 and 42, respectively, so as to anchor them in these regions to the borehole 1.

The inner section 42 is provided with an end cap 6d having a cutting tip 7d serving to embed it in the mass 8d. Similarly the outer end 41 is covered with a cap 23 having a hexagonal axial projection 24 adapted to be fitted to a wrench. The cap 23 is connected via a key 164 to the tube section 41 so that the nut 24 rotationally turns the entire tube 40.

The entire tube 40 is lined with a cylindrical friction lining 5d. A connecting rod 2d lies within this tube 40 on the axis A and has at one end a cylindrical annular body 30 and at the other end a cylindrical annular body 31. The outer diameters of these bodies 30 and 31 are the same as the inner diameters of the lining 5 so that these bodies 30 and 31 tightly frictionally engage this lining 5d. Thus it is possible for the end portion 30 to slide inside the tube 41 through a distance *f* and the body 31 inside the tube section 42 through a distance *e.* Thus when the ends 41 and 42 are stressed axially relative to one another they can break-apart at the region 20, leaving the inner section 42 tightly in place and allowing the outer section 41 to slide relative to the inner section through a distance equal to $e + f$.

It is possible in this arrangement to provide a rotary link 165 between the inner end of the connecting element 2d and the plate 6d, in which case the element 30 may be connected rigidly to the cap 23.

FIG. 6 shows an arrangement identical to that of FIG. 5, except that the body 31 is replaced by a two-part body 31a having an outer sleeve 31a' secured in the sleeve 42 and an inner sleeve 31a'' secured on the rod 2d. These two sleeves meet at a frustoconical surface tapering toward the middle of the rod 2d and toward the outer end of the rockbolt assembly. Deformation of the sleeve 31a' is necessary for slippage in the assembly.

Figure 7:
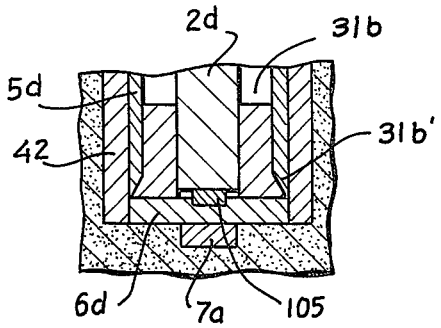

In FIG. 7 the arrangement of FIG. 5 is shown with the body 31 replaced by a body 31b having a flared lower edge end portion 31b' that engages into the layer 5d, which is constituted in this case of a soft deformable metal.

Figure 8:
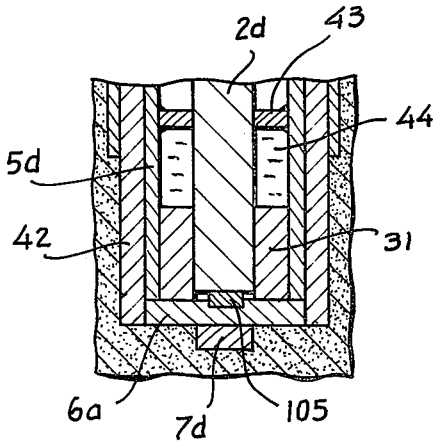
FIG. 8 is a view similar to FIG. 5 illustrating in axial section another arrangement in accordance with this invention.

The rockbolt of FIG. 8 is identical to that of FIG. 5 except that a ring 43 carried on the sleeve 42 defines a fluid-filled chamber 44 above the body 31. The fluid in this chamber 44 must be forced out for the rockbolt assembly to slip so that hydraulic damping is provided rather than the shear-type of damping in FIG. 7.

In all such anchor or rockbolt arrangements the outer element may be formed as an eye, or may be provided with a threaded hole so as to allow connection to this outer element if used as an anchor or may be provided with a threaded rod to allow fixing an anchor plate or a washer if used as a rockbolt.

It will be understood that each of the elements described above, or two or more together may also find a useful application in other types of constructions differing from the types described above.

While the invention has been illustrated and described as embodied in a borehole anchor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An anchor assembly for mounting in a borehole in a rock, said assembly comprising:

an outer element defining an axis;

means for securing said outer element proximal to the mouth of said borehole;

an inner element limitedly axially displaceable relatively to said outer element through a predetermined axial distance;

means for securing said inner element in said borehole distal from the mouth of said borehole;

a friction surface on one of said elements having a predetermined axial length equal at least to said axial distance;

a friction surface on the other of said elements transversely engageable with said surface of said one element and displaceable axially therealong through said distance; and means pressing said surface of said other element transversely against said surface of said one element with a predetermined constant force for interconnecting said inner and outer elements and allowing limited mutual axial shifting thereof through said distance without disconnection only on axial stressing of said elements relative to each other beyond a predetermined limit.

2. The assembly defined in claim 1 wherein said means for securing said inner element in said borehole is a mass of adhesive between said inner element and the interior wall of said borehole.

3. The assembly defined in claim 2, further comprising means rotationally linking said inner and outer elements, whereby rotation of said outer element turns said inner element.

4. The assembly defined in claim 2 wherein said surfaces are slidably displaceable relative to one another on such stressing along said axis.

5. The assembly defined in claim 4 wherein said one element frictionally engages said other element, whereby said elements can only shift relative to one another when stressed with a force overcoming the frictional force between them.

6. The assembly defined in claim 5 wherein said inner element is formed as a sleeve bedded in said mass of adhesive in said borehole, said outer element being a rod lying on said axis and concentric with said sleeve.

7. The assembly defined in claim 6 wherein said rod has an inner end provided with a cylindrical body constituting the interconnecting means and frictionally radially engaging the inner wall of said sleeve constituting said surface of said inner element.

8. The assembly defined in claim 7, wherein said interconnecting means includes a friction lining on said inner wall constituting the respective friction surfaces between same and the outer surface of said cylindrical body carried on said rod, said outer surface constituting said the other friction surface.

9. The assembly defined in claim 6 wherein said rod has a flared inner end constituting the interconnecting means and engageable with the inner wall of said sleeve.

10. The assembly defined in claim 5 wherein each of said elements is a rod lying on said axis and having an axial extension with a surface lying against the corresponding surface of the other extension, the interconnecting means including means for pressing said surfaces together transversely to said axis.

11. The assembly defined in claim 10 wherein said means for pressing includes at least one ring surrounding said projections.

12. The assembly defined in claim 11 wherein said means for pressing includes two such rings and each of said extensions is formed with a laterally projecting abutment engageable with a respective ring for limiting relative axial displacement of said rods.

13. The assembly defined in claim 11 wherein said extensions are semicylindrical and have relative to the respective rods flat diametrical faces constituting said surfaces.

14. The assembly defined in claim 5 wherein said elements are coaxial and abutting tube sections, said assembly further comprising a connecting element constituting the interconnecting means and lying within and frictionally interconnecting said sections.

15. The assembly defined in claim 14 wherein said tube sections are generally cylindrical and said connecting element is a rod having a pair of end portions each slidable piston-fashion within a respective one of said sections.

16. The assembly defined in claim 15 wherein said tube sections are both part of a common integral tube having a weakened waist section defining said sections.

17. The assembly defined in claim 16, wherein said tube has an outer end provided with a cover cap and an inner end provided with a cover plate preventing entry of liquid into said tube.

18. The assembly defined in claim 5, further comprising a polygonal projection on said outer element permitting rotation thereof about said axis.

19. The assembly defined in claim 5, further comprising a cutting tip on the inner end of said inner element, whereby rotation of said assembly allows said tip to bore into said adhesive before hardening thereof.

20. The assembly defined in claim 5 wherein said rod has an inner end provided with a body having a frustoconical upper portion tapering toward the mouth of said borehole and constituting the interconnecting means, said body frictionally radially engaging the inner wall of said sleeve.

21. The assembly defined in claim 1 wherein said means includes a body fixed between said elements and adapted to shear on mutual displacement of said elements.

22. The assembly defined in claim 1, further comprising means for inhibiting displacement of said elements relative to each other beyond said axial distance even when stressed with an axial force exceeding said predetermined limit.

* * * * *